US007578385B2

(12) United States Patent
Holley, Jr.

(10) Patent No.: US 7,578,385 B2
(45) Date of Patent: Aug. 25, 2009

(54) CARRIER WITH TOGGLE-ACTION BOTTOM WALL

(75) Inventor: John M. Holley, Jr., Lawrenceville, GA (US)

(73) Assignee: Mead Westvaco Packaging Systems, LLC, Glen Allen, VA (US)

( * ) Notice: Subject to any disclaimer, the term of this patent is extended or adjusted under 35 U.S.C. 154(b) by 191 days.

(21) Appl. No.: 11/419,446

(22) Filed: May 19, 2006

(65) Prior Publication Data

US 2006/0283724 A1 Dec. 21, 2006

Related U.S. Application Data

(60) Provisional application No. 60/682,624, filed on May 19, 2005.

(51) Int. Cl.
*B65D 65/00* (2006.01)

(52) U.S. Cl. ..... 206/170; 206/193

(58) Field of Classification Search ..... 206/162, 206/170, 175, 193, 171, 172, 174
See application file for complete search history.

(56) References Cited

U.S. PATENT DOCUMENTS 2,681,143 A 6/1954 Guyer
2,794,571 A 6/1957 Fielding
3,126,145 A 3/1964 Struble
3,809,310 A 5/1974 VanderLugt, Jr.
3,860,113 A * 1/1975 Helms ..... 206/185
4,032,007 A * 6/1977 Graser et al. ..... 206/173
4,171,046 A * 10/1979 Bonczyk ..... 206/193
4,601,390 A * 7/1986 Rosenthal et al. ..... 206/175
5,161,732 A 11/1992 Clein
5,505,304 A * 4/1996 Broskow et al. ..... 206/427
5,657,865 A * 8/1997 Harrelson ..... 206/194

FOREIGN PATENT DOCUMENTS

CA 1066671 11/1979

* cited by examiner

*Primary Examiner*—Jacob K Ackun, Jr.
(74) *Attorney, Agent, or Firm*—Parks Knowlton LLC; Tsugihiko Suzuki

(57) ABSTRACT

A carrier (800) that is reversibly erectable from a collapsed condition to an erected condition and that reliably maintains its erected condition. The carrier includes a tubular portion defined by side walls (118, 146, 152, 142, 156, 160) and a bottom wall defined by bottom panels (230, 260). The bottom panels are hingedly connected to an edge of the tubular structure. Gusset structures connect the bottom panels to the tubular structure and cause the bottom panels to toggle as the carrier is erected. The gusset structures additionally retain the bottom wall in the erected condition. In the erected condition, the bottom wall of the carrier includes a buffer for limiting or preventing damage to articles as they are loaded into the carrier. The handle of the carrier is ergonomically defined in multiple planes and includes handle flaps including curved portions that improve the comfort of a handle.

9 Claims, 11 Drawing Sheets

170
248
148
122
152
242
110
150
257
241
245
800
240
246
118
146
258
243
244
230
174
$F_e$
272
260
284
160
116
270
276
156
216
184
142
286
114
132
278
161
162
290
282
288
180

870
$F_3$
860
440
820
835
$F_1$
815
$C_3$
840
302
438

130
184
825
128
$C_1$
140
220
$F_2$
800
126
$C_2$
226
830
122
136
216
138
160
810
132
286
170
245
260
290
146
230
282
850
284
242
156
260
240
118
142

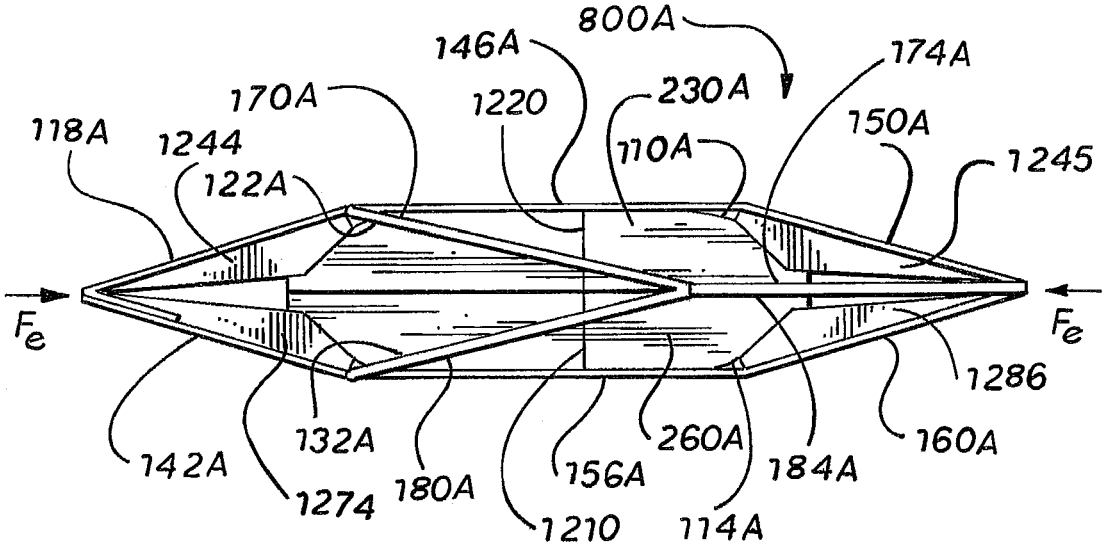
Fig_13
Fig_12
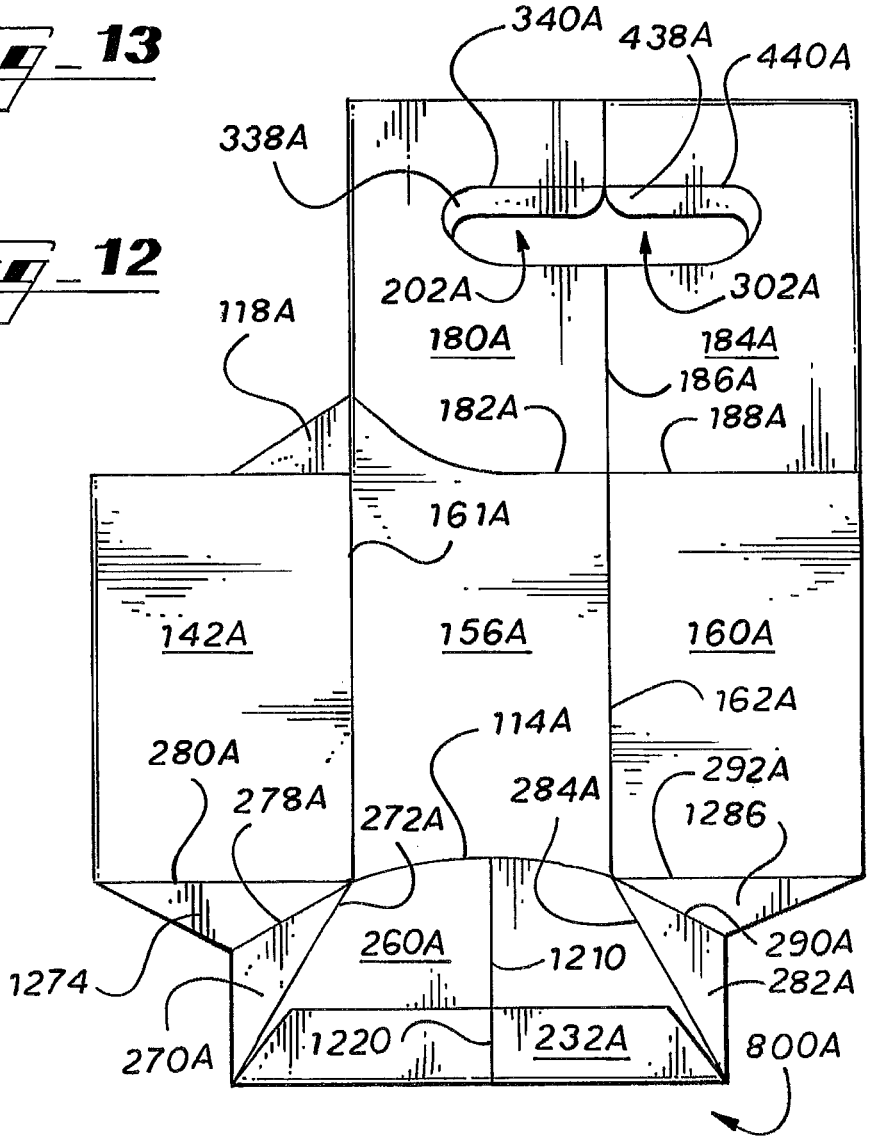

CARRIER WITH TOGGLE-ACTION BOTTOM WALL

RELATED APPLICATIONS

This application claims priority to U.S. Application No. 60/682,624, filed May 19, 2005, the entirety of which is incorporated herein by reference.

TECHNICAL FIELD

This invention relates to carriers and, more particularly, to a carrier that is reversibly erectable from a collapsed condition to an erected condition and includes a toggle-action bottom wall.

BACKGROUND OF THE INVENTION

Basket style carriers are known in the art, and generally consist of a configuration that may be converted from a collapsed condition, for shipping and storage, to an erected condition for receiving and carrying articles, such as bottles. However, many of these carriers are either difficult to erect or fail to stay erected, thereby making such carriers difficult to load. In addition, articles that are drop-loaded into these carriers may be damaged when they contact the bottom wall of the carrier, which is typically set on a hard surface. Furthermore, it is sometimes desirable to provide a handle structure that is defined in multiple planes, so that the handle structure can be accessed from various vantage points. However, the composite handles provided on carriers with such a handle structure are often inconvenient or uncomfortable to use.

Thus, there is a need for a carrier that can readily toggle or spring between a collapsed condition and an erected condition, and maintain its erected condition. There is also a need for a carrier that provides an inherent cushion or buffer at the bottom wall of the carrier or prevent damage to breakable articles during loading, for example, as glass bottles are drop-loaded into the carrier by automated equipment. Further, there is also a need for a carrier having a handle that is convenient and comfortable for carrying.

SUMMARY OF THE INVENTION

The various embodiments of the present invention overcome the shortcomings of the prior art by providing a carrier that is reversibly erectable from a collapsed condition to an erected condition and that reliably maintains its erected condition. In the erected condition, the bottom wall of the carrier includes a buffer for limiting or preventing damage to articles as they are loaded into the carrier. The handle of the carrier is ergonomically defined in multiple planes and includes handle flaps including curved portions that improve the comfort of a handle.

Generally, the carrier includes multiple side walls that define a tubular structure, as well as a bottom wall and gusset structures that connect the bottom wall to the tubular structure. The bottom wall includes two bottom panels which are each hingedly connected to an edge of the tubular structure and which are connected in a partially overlapping arrangement to each other. Each gusset structure is hingedly connected to one of the bottom panels and to the tubular structure. According to one aspect of the invention, the arrangement of the bottom panels and the gusset structures with respect to the tubular structure yields a bottom wall that is somewhat springy so as to provide the buffer that cushions the bottoms of the articles placed in the carrier.

According to another aspect of the invention, the carrier is partially erected, such as by inplant equipment (IPE), in such a manner as to be easily collapsed for shipping or storage. In the collapsed condition, the entire carrier is substantially flattened, having coplanar surfaces with two side edges. The carrier is fully erected simply by applying pressure, either manually or automatically, such as via out plan equipment, to each side edge of the flattened carrier. The pressure is applied in such a manner as to urge the side edges toward one another. Ie, opposing forces applied generally in alignment with the plane of the flattened carrier cause the then coplanar surfaces to spring apart to form a tubular structure, and also causes the bottom wall to spring into place, such that the bottom panels are substantially coplanar to one another and are substantially perpendicular to the sidewalls of the tubular structure. The bottom wall, in effect, encloses an open end of the tubular structure. The gusset panels are rotatable to urge the bottom panels to toggle to form the bottom wall, and to maintain the bottom wall and tubular structure in an erected condition.

According to another aspect of the invention, each exemplary carrier includes at least a first handle portion having a first handle cutout and a second handle portion having a second handle cutout. The first and second handle portions are connected along a tubular axis of the tubular structure such that the handle cutouts are interconnected to define a handle aperture. The first handle portion is at an angle relative to the second handle portion such that the handle aperture is defined in multiple planes. In certain embodiments, the first and second handle portions may be hingedly connected along a fold line such that the handle aperture interrupts the fold line. Each of the handle cutouts includes a handle flap. Each of the handle flaps include a curved portion which, together, define a recess that is adjacent to the tubular axis.

In a first embodiment, the gusset structures each include a gusset attaching tab and a gusset panel. The gusset panel is hingedly connected to one of the bottom panels and hingedly connected to the gusset attaching tab. The outside surface of the gusset attaching tab is secured to the inside surface of the tubular structure such that the gusset panel is hingedly connected to the inside surface of the tubular structure.

When the carrier is in a collapsed condition, the bottom panels, gusset structures, and side walls are substantially coplanar as described in general above. Specifically, the outside surfaces of the bottom walls are folded in a face contacting relationship with respect to one another, and the inside surface of each of the bottom walls are folded in a face contacting relationship with the inside surface of the tubular structure. The outside surface of each of the gusset panels is folded in a face contacting relationship with the inside surface of the tubular structure. The inside surface of a first gusset panel that is hingedly connected to one of the bottom panels is folded in a face contacting relationship with the inside surface of one of the second gusset panel that is hingedly connected to the other bottom panel.

When the carrier is in an erected condition, the outside surface of each of the gusset panels approaches a face contacting relationship with the inside surface of the tubular structure.

Overlapping portions of the bottom panels are secured together to form the bottom wall. More specifically, distal portions of the outside surfaces of the bottom panels are secured together in a face contacting arrangement. The overlapping portions extend at an angle with respect to the plane defined by the bottom wall to form a deflectable buffer. The buffer lessens the impact between articles and the bottom wall of the carrier when articles are loaded into the carrier.

In a second embodiment of the invention, the gusset structures include first and second gusset panels that are hingedly connected to one another. The first gusset panel is additionally hingedly connected to one of the bottom panels and the second gusset panel is hingedly connected along a portion of the bottom edge of the tubular structure.

When the carrier is in a collapsed condition, the bottom panels, gusset structures, and side walls are substantially coplanar as described in general above. Specifically, the inside surfaces of the bottom walls are in a face contacting relationship and extend from an edge of the tubular structure. The inside surface of each gusset panel of a first gusset structure that is hingedly connected to one of the bottom panels is in a face contacting relationship with the inside surface of respective gusset panels of a second gusset structure that is hingedly connected to the other bottom panel.

When the carrier is in an erected condition, the inside surface each of the second gusset panels approaches a face contacting relationship with the inside surface of the tubular structure and the outside surfaces of respective first and second gusset panels approach a face contacting relationship with one another. Further, the bottom panels are substantially coplanar to one another and are substantially perpendicular to the sidewalls of the tubular structure. The bottom wall, in effect, encloses an open end of the tubular structure.

In this embodiment, the bottom wall may be formed by overlapping the bottom panels as described above, but is preferably formed as follows. The overlapping portions include the outside surface of the distal end of one of the bottom panels, which is secured to the inside surface of the distal end of the other bottom panel. The buffer is formed in part by providing score lines that extend across the bottom wall transversely with respect to the overlapping distal edges. The score lines terminate at the bottom edge of the tubular structure. The bottom edge of the tubulartabular structure is curved to encourage the bottom wall to bow inwardly with respect to the tubulartabular structure so as to be concave. Thus, the bottom wall tends to be at least partially suspended, or otherwise disposed above, a flat surface upon which the erected carrier rests, such that a buffer is formed there between.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

FIG. 12 is a plan view of a carrier formed from the blank of FIG. 11, the carrier being in a collapsed condition.

FIG. 13 is a top view of the carrier of FIG. 12, the carrier being partially erected.

DETAILED DESCRIPTION

Figure 1:
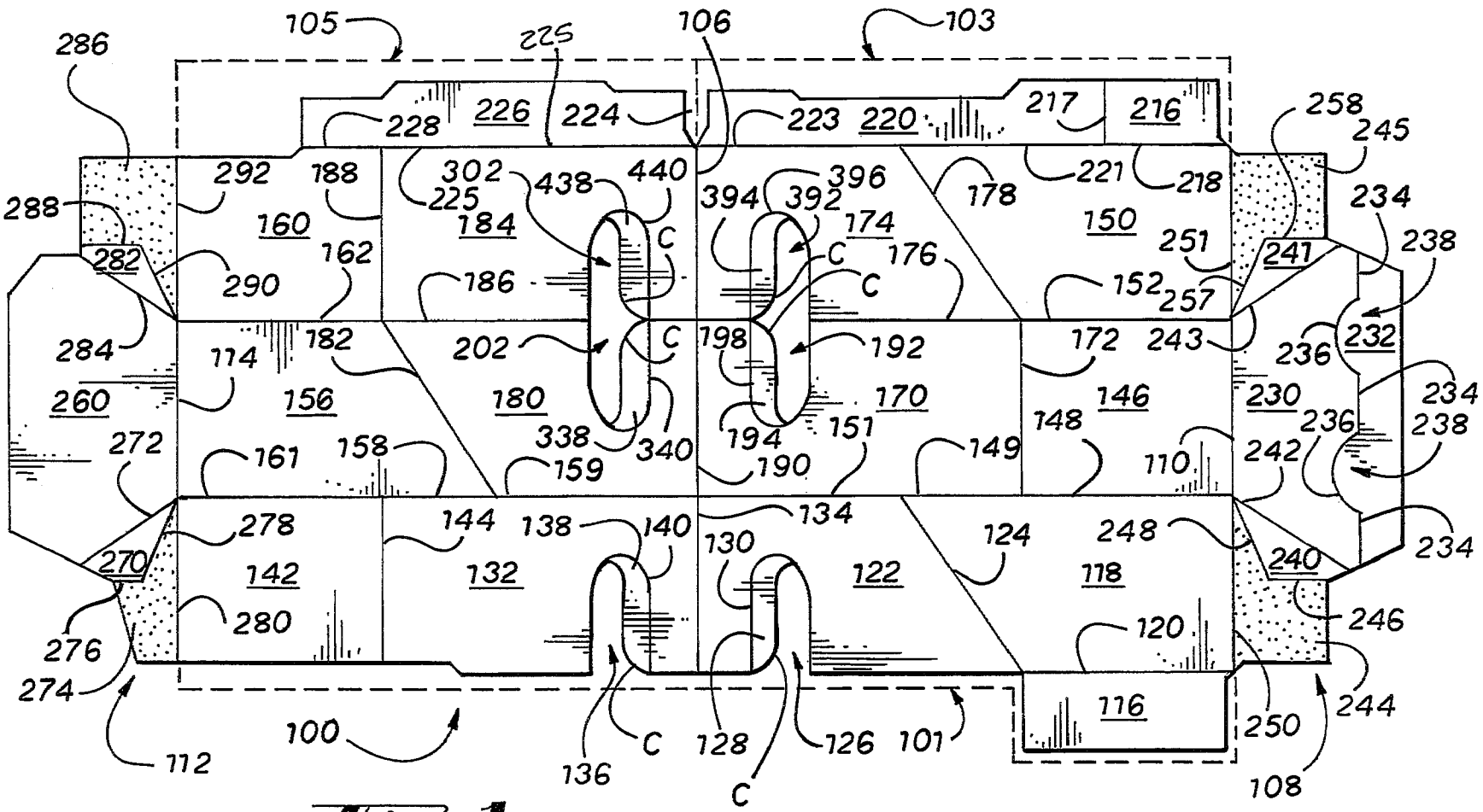
FIG. 1 is a plan view of a blank in accordance with an exemplary embodiment of the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention. In addition, it should be noted that the term fold line may include simple score lines, partially cut score lines, perforated lines, and other suitable means for folding.

Referring now to the drawings, wherein like numerals indicate like elements throughout the several views, the drawings illustrate various aspects of exemplary embodiments of a basket-style carrier that is reversibly erectable from a collapsed condition to an erected condition. In the exemplary embodiments, the carriers are arranged to accommodate three cylindrical articles. However, the blank and carrier may be modified to accommodate any number of bottles, cans, or other articles. Generally described, the carrier includes a tubular structure formed from multiple sidewalls, a bottom wall formed from bottom panels, and gusset structures connecting the tubular structure and the bottom wall. At least a portion of each gusset structure is rotatable such that the bottom panels toggle to form the bottom wall as the carrier is reversibly erected from a collapsed condition to an erected condition. Further, the gusset structures retain the bottom wall and tubular structure in the erected condition.

Figure 8:
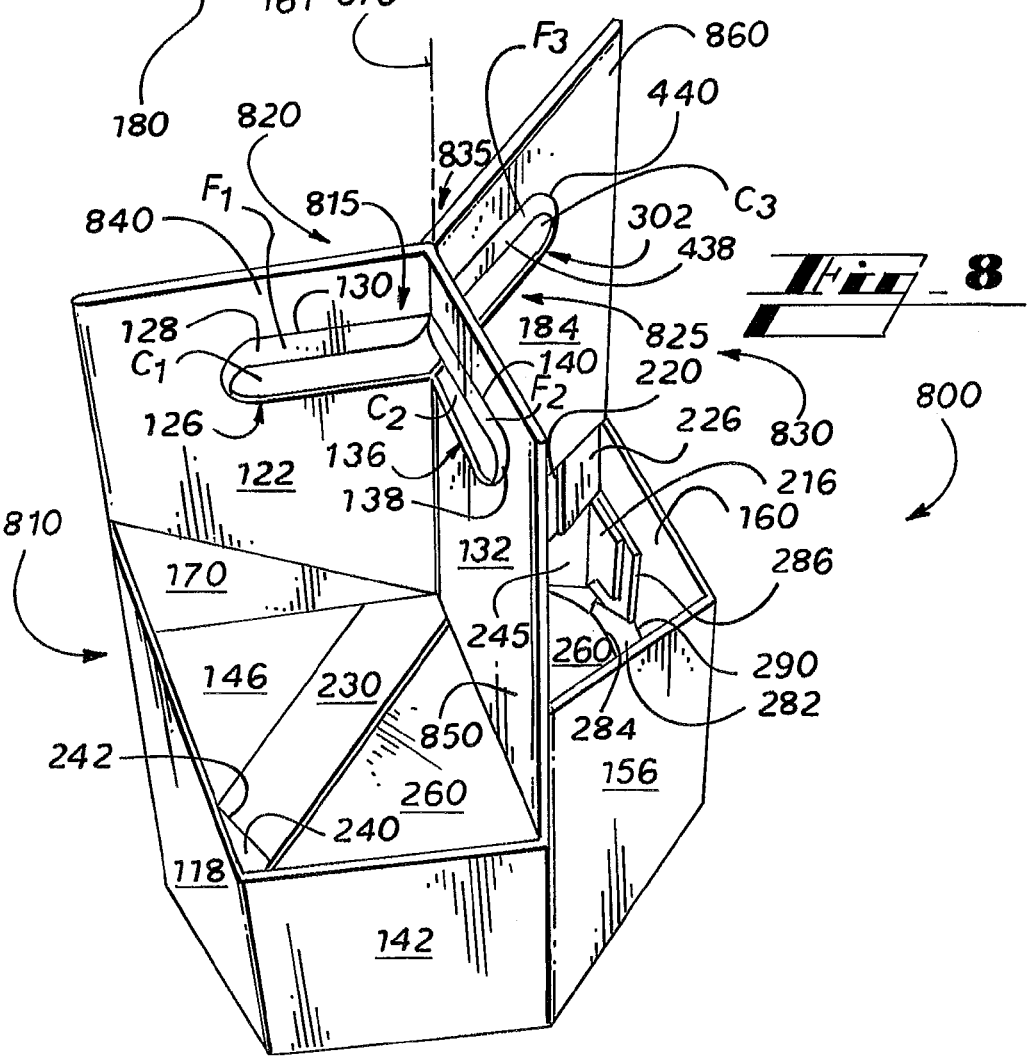
FIG. 8 is a perspective view of the carrier formed from the blank of FIG. 1, the carrier being in an erected condition.

Referring to FIG. 1 and with occasional reference to FIG. 8, there is shown an exemplary embodiment of a blank 100, which when constructed forms a carrier 800 for enclosing a plurality of articles. The blank 100 includes three primary sections of panels. Each section is indicated with dashed lines and includes panels which define the walls of a receiving cell of the carrier 800. Specifically, a first section 101 includes panels for defining a first receiving cell 810, a second section 103 includes panels for defining a second receiving cell 820, and a third section 105 includes panels for defining a third receiving cell 830. The blank 100 also includes bottom structure panels 108, 112. Each of the bottom structure panels 108, 112 includes a bottom panel and gusset structures for forming the bottom wall of the carrier 800.

The first section 101 includes major sidewall panel 118, minor sidewall panel 142, major divider wall panel 122, and minor divider wall panel 132. The first section 101 panels are aligned longitudinally. The divider wall panels 122, 132 are separated along a severance line 134 and separated from the sidewall panels 118, 142 along severance lines 124, 144. The angle and curvature of the severance lines in the blank 100 is a design decision which may provide aesthetic appeal or shape the sidewalls of the carrier in order to provide additional support to the articles. In the exemplary embodiment, the severance line 124 is oblique and the severance line 144 is straight.

As described herein, major sidewall panels and major divider wall panels are separated by an oblique severance line. Minor sidewall panels and minor divider wall panels are separated by a straight severance line. As can be seen in FIG. 8, for a carrier 800 in an erected condition, sidewalls which are defined by major sidewall panels have a greater maximum height than sidewalls defined by minor sidewall panels.

Returning to FIG. 1, each of the divider wall panels 122, 132 include a cutout 126, 136, respectively. A cushioning flap 128, 138 is hingedly connected to the edge of each cutout 126, 136 along a fold line 130, 140. The flaps 128, 138 include curved portions C, as described in further detail below.

The second section 103 includes minor sidewall panel 146, minor divider wall panel 170, major sidewall panel 150, and major divider wall panel 174. The minor sidewall panel 146 is hingedly connected to the major sidewall panel 150 along a fold line 152. The minor sidewall panel 146 is separated from the minor divider wall panel 170 by a severance line 172. The minor divider wall 170 is hingedly connected to major divider wall panel 174 along a fold line 176. The major sidewall panel 150 is separated from the major divider wall panel 174 by an oblique severance line 178. Each of the divider wall panels 170, 174 includes a cutout 192, 392 that together define an aperture. A cushioning flap 194, 394 is hingedly connected to the edge of each cutout along fold lines 198, 396. Each flap 194, 394 includes a curved portion C that extends to the intersection of the fold line 396 and the fold line 176.

The third section 105 includes minor sidewall panel 160, minor divider wall panel 184, major sidewall panel 156, and major divider wall panel 180. The major sidewall panel 156 is hingedly connected to the minor sidewall panel 160 along a fold line 162. The major sidewall panel 156 is separated from the major divider wall panel 180 by an oblique severance line 182. The major divider wall panel 180 is hingedly connected to the minor divider wall panel 184 along a fold line 186. The minor divider wall panel 184 is separated from the minor sidewall panel 160 by a severance line 188. Each of the divider wall panels 180, 184 includes a cutout 202, 302 that together define an aperture. A flap 338, 438 is hingedly connected to the edge of each cutout 202, 302 along a fold line 340, 440. Each flap 338, 438 includes a curved portion C that extends to the intersection of the fold line 440 and the fold line 186.

The second section 103 and the third section 105 are hingedly connected to one another and each is further hingedly connected to the first section 101. The second section 103 is hingedly connected to the first section along fold lines 148, 149, 151. The third section 105 is hingedly connected to the first section 101 along fold lines 158, 159, 161. The second section 103 is hingedly connected to the third section 105 along fold line 106 and separated from the third section 105 along severance line 190. Specifically, the major sidewall panels 118, 156 are hingedly connected to the minor sidewall panels 146, 142 along fold lines 148, 161, respectively, and to the minor divider wall panels 170, 132 along fold lines 149, 158, respectively. The major divider wall panels 122, 180 are hingedly connected to the minor divider wall panels 170, 132 along fold lines 151, 159, respectively. The major divider wall panel 180 is separated from the minor divider wall panel 170 by the severance line 190.

The bottom structure panels 108, 112 each include a bottom panel 230, 260 and gusset structures. Each gusset structure includes a gusset panel 240, 241, 270, 282 and a gusset attaching tab 244, 245, 274, 286, respectively. Generally described, the gusset panels 240, 241, 270, 282 are triangular shaped and are hingedly connected to a respective bottom panel 230, 260 along an oblique fold line 242, 243, 272, 284, respectively, and to a gusset attaching tab 244, 245, 274, 286 along an oblique fold lines 248, 257, 278, 290. Gusset panels 240, 241, 270, 282 and gusset attaching tabs 244, 245, 274, 286 are separated along severance lines 246, 258, 276, 288, respectively.

The gusset attaching tabs and bottom panels of the bottom structure panels 108, 112 are hingedly connected to the sidewall panels of the primary sections 101, 103, 105. Specifically, bottom panel 230, 260 is hingedly connected to sidewall panel 146, 156 along a fold line 110, 114, respectively. Gusset attaching tab 244, 245, 274, 286 is hingedly connected to sidewall panel 118, 150, 142, 160 along a fold line 250, 251, 280, 292.

A foldable end flap 232 is hingedly connected to bottom panel 230 along fold line 234. Curved severance lines 236 interrupt or otherwise extend between portions of the fold line 234 and define foldable attachment portions 238. The foldable attachment portions 238 facilitate and reinforce the attachment to a bottom panel 260 during assembly of the carrier 800, as described in further detail below.

The blank 100 further includes attaching end flaps and attaching tabs to facilitate assembly of the carrier 800. The end flaps 220, 226 are hingedly connected to the panels of the second and third sections 103, 105, respectively. Specifically, the end flap 220, 226 is hingedly connected to sidewall panel 150, 160 along a fold line 223, 225 and hingedly connected to divider wall panel 174, 184 along a fold line 221, 228, respectively. Tabs 116, 216 are hingedly connected to the panels of the first and second sections 101, 103, respectively. Specifically, the tab 116, 216 is hingedly connected to the sidewall panel 118, 150 along a fold line 120, 218, respectively. The end flap 220 and the tab 216 are separated by a severance line 217. The end flaps 220, 226 are separated by a notch 224.

Turning now to the configuration illustrated in FIG. 8, the blank 100 may be assembled to form the carrier 800 through a series of folding and securing operations. The operations may be performed in a straight line machine so that the carrier is not required to be rotated or inverted to complete the assembly. However, the folding process is not limited to the process described below and may be altered, for example, according to particular manufacturing requirements. For clarity, the application of adhesive is described as being applied as multiple assembly steps, although all adhesive may be applied simultaneously or in a single step.

Figure 2:
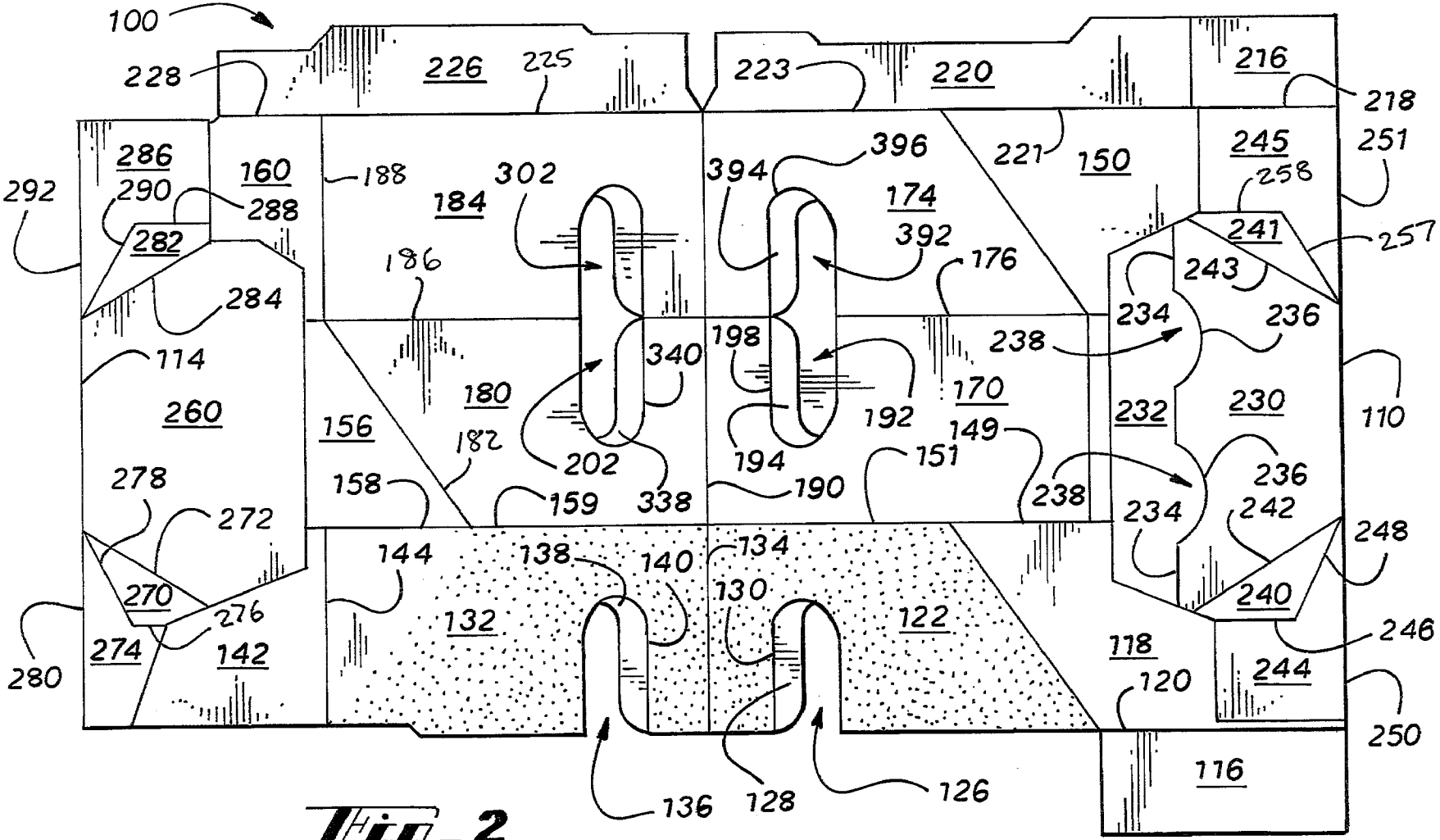
FIGS. 2-3 are plan views of the blank of FIG. 1 as it is folded to form an exemplary carrier.

Initially, adhesive is applied to the inner surface of gusset attaching tabs 244, 245, 274, 286, as indicated by the stippling in FIG. 1. Bottom structure panels 108, 112 are then folded along fold lines 110, 250, 251 and 114, 280, 292, respectively, to be in a face contacting arrangement with the sidewall panels 118, 146, 150 and 142, 156, 160, respectively, as shown in FIG. 2. More particularly, gusset attaching tabs 244, 245 are folded about fold lines 250, 251 and bottom panel 230 is folded along fold line 110 so that gusset attaching tabs 244, 245 are secured to sidewall panels 118, 150, respectively. Likewise, gusset attaching tabs 274, 286 are folded about fold lines 280, 292 and bottom panel 260 is folded about fold line 114 so that attaching tabs 274, 286 are secured to sidewall panels 142, 160, respectively.

Adhesive is then applied to major divider wall panel 122 and minor divider wall panel 132, as shown by stippling in FIG. 2, and may optionally be applied to minor divider wall panel 170 and major divider wall panel 180. It should be noted that adhesive is preferably not applied to portions of the minor divider wall panel 132 that may contact major sidewall panel 156 when folded along fold line 158 so as to allow movement of the major sidewall panel 156 when the carrier 800 is erected.

The major divider wall panel 122 is folded about fold line 151 to be in a face contacting relationship with minor divider wall panel 170. Similarly, the minor divider wall panel 132 is folded along fold lines 158 and 159 to be in a face contacting relationship with the major divider wall panel 180. Thereby, the cutout 126 overlays the cutout 192 and the cutout 136 overlays the cutout 202.

Figure 3:
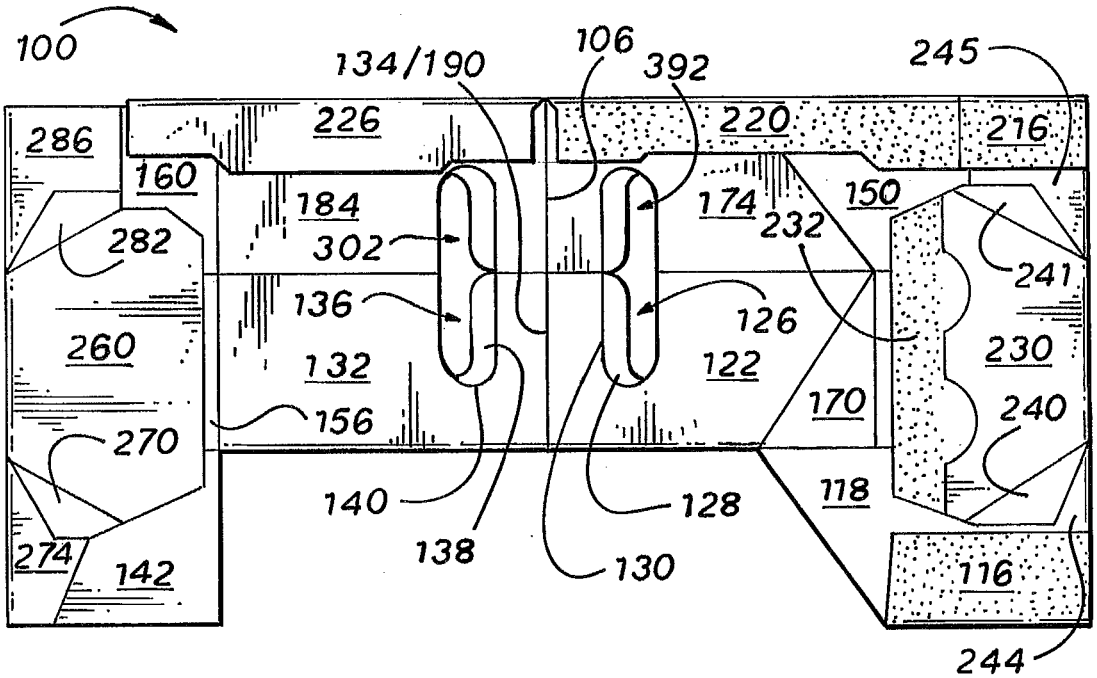

Referring to FIGS. 2 and 3, a sequence of folding operations includes folding the attaching tab 116 along fold line 120, folding the attaching tab 216 along fold line 218, folding the attaching end flap 220 along fold lines 221, 223, and folding the attaching end flap 226 along fold line 228. Thereby, the blank 100 reflects the configuration shown in FIG. 3.

Figure 4:
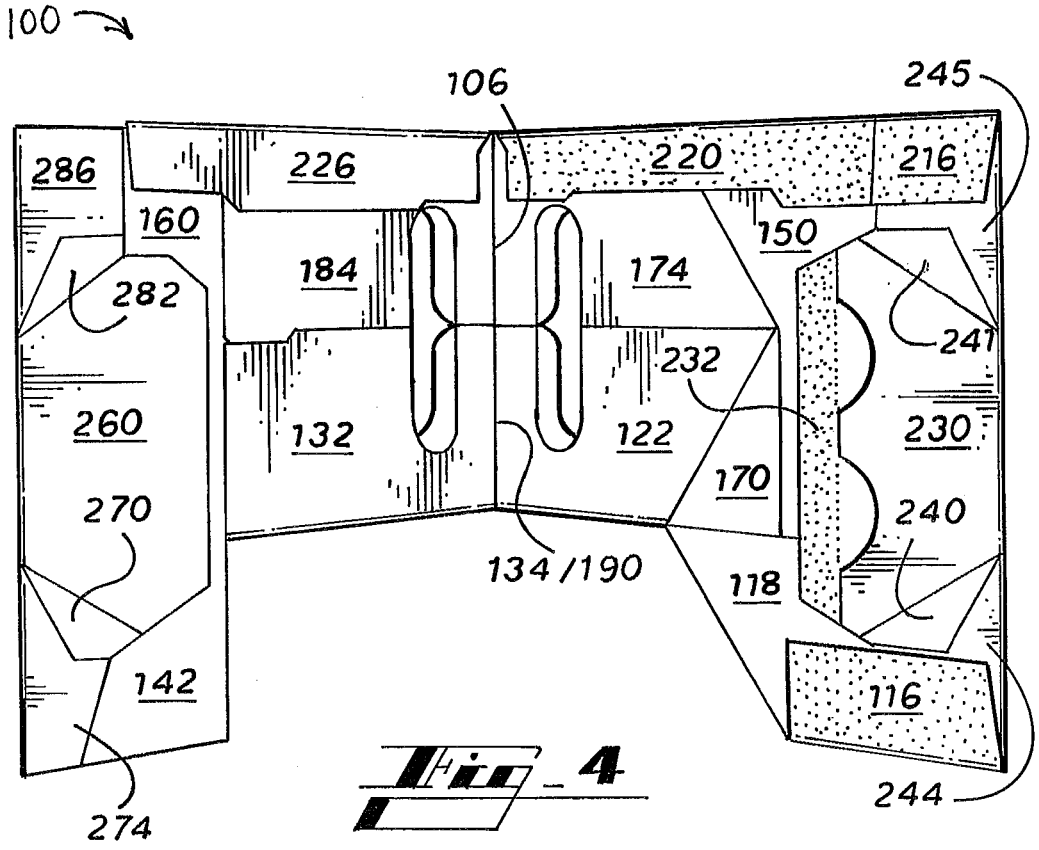
FIG. 4 is a perspective view of the blank of FIG. 1 as it is folded to form an exemplary carrier.
Figure 6:
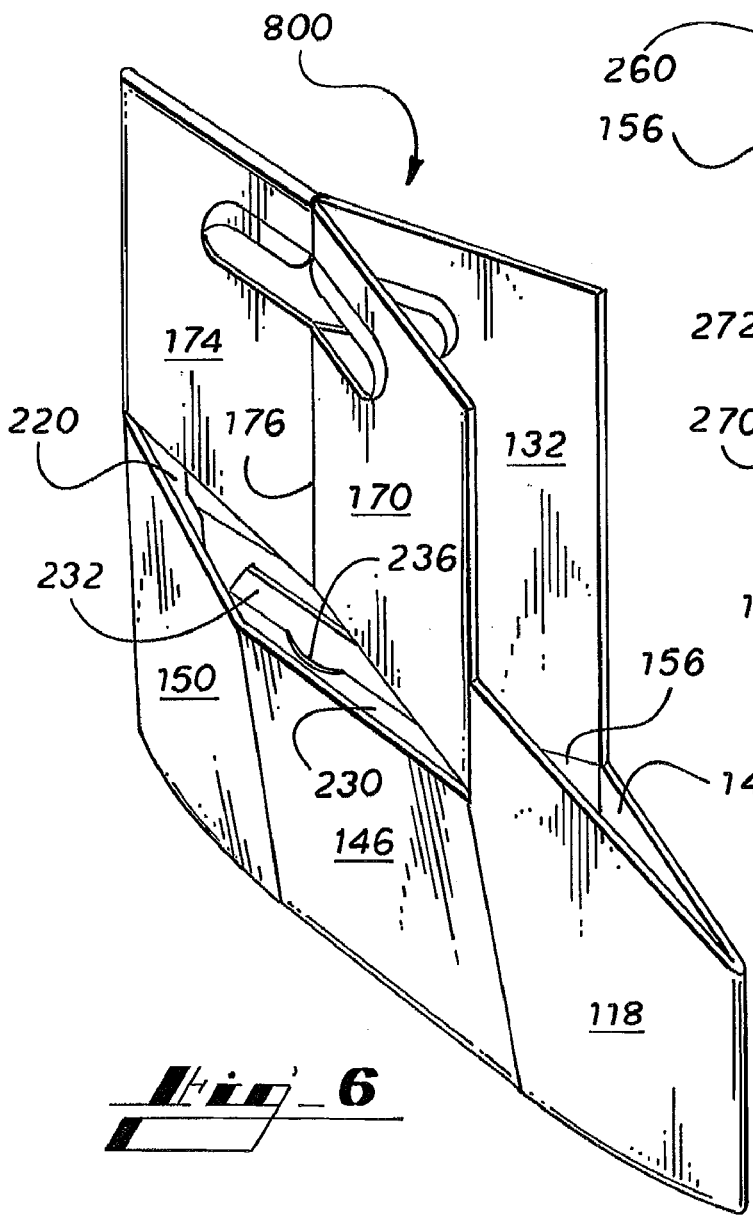

Adhesive is applied to the surface of the attaching tab 116, the attaching tab 216, the attaching end flap 220, and the foldable end flap 232, as shown by the stippling in FIG. 3. The blank 100 is then folded about fold line 106 and severance lines 190/134, as shown in FIG. 4, such that certain panels of the blank 100 are in a face contacting relationship and secured to one another as shown in FIG. 6. Specifically, attaching tabs 116, 216 are secured to the gusset attaching tabs 286, 274, respectfully. The attaching tab 116 is additionally secured to the inside surface of the minor sidewall panel 142. Thereby, the sidewall panels of the blank 100 form a substantially collapsed tubular structure. Additionally, the foldable end flap 232 is secured to the bottom panel 260 to hingedly connect the bottom panels 230, 260 to one another and the attaching end flaps 220, 226 are secured to one another. The carrier 800 is thereby formed in a collapsed condition. Hereinafter, sidewall panels will be referred to as sidewalls and divider wall panels will be referred to as divider walls.

As best seen in FIG. 8, the erected carrier includes six divider walls 122, 132, 180, 184, 170, 174, which combine to form three two-ply handle portions 840, 850, 860 that partition the receiving cells 810, 820, 830. Each handle portion 840, 850, 860 includes two divider walls having overlapping cutouts and flaps. Specifically, the first handle portion 840 includes the divider wall 122 and the divider wall 170, having overlapping cutouts 126, 192 and overlapping flaps 128, 194, which form a first handle cutout C1 and a first handle flap F1. The second handle portion 850 includes the divider wall 132 and the divider wall 180 having overlapping cutouts 136, 202 and overlapping flaps 138, 338 which form a second handle cutout C2 and a second handle flap F2. The third handle portion 860 includes the divider wall 174 and the divider wall 184 having overlapping cutouts 392, 302 and overlapping flaps 394, 438 which form a third handle cutout C3 and a third handle flap F3.

Three handle apertures 815, 825, 835 are defined in the carrier 800. Each of the three handle apertures 815, 825, 835 is defined by a combination of two of the handle cutouts C1, C2, C3 of handle portions 840, 850, 860. The first handle aperture 815 includes the handle cutouts C1, C2 of the handle portions 840, 850, the second handle aperture 825 includes the handle cutouts C2, C3 of the handle portions 850, 860, and the third handle aperture 835 includes the handle cutouts C3, C1 of the first handle portions 840, 860. When the carrier 800 is erected, adjacent handle portions 840, 850, 860 are at an angle with respect to one another such that each handle aperture 815, 825, 835 is defined in multiple planes. The handle cutouts C1, C2, C3 of the handle portions 840, 850, 860 are interconnected, as are the handle portions 840, 850, 860, at a tubular axis 870. The handle flaps F1, F2, F3 include curved portions C to facilitate carrying the carrier 800. Specifically, the curved portions C eliminate a cumbersome edge that would be adjacent to the tubular axis 870 for each handle aperture 815, 825, 835. It is contemplated that a divider (not shown) can separate the handle cutouts C1, C2, C3, such that each handle aperture is disposed in a single handle portion 840,850,860.

Figure 5:
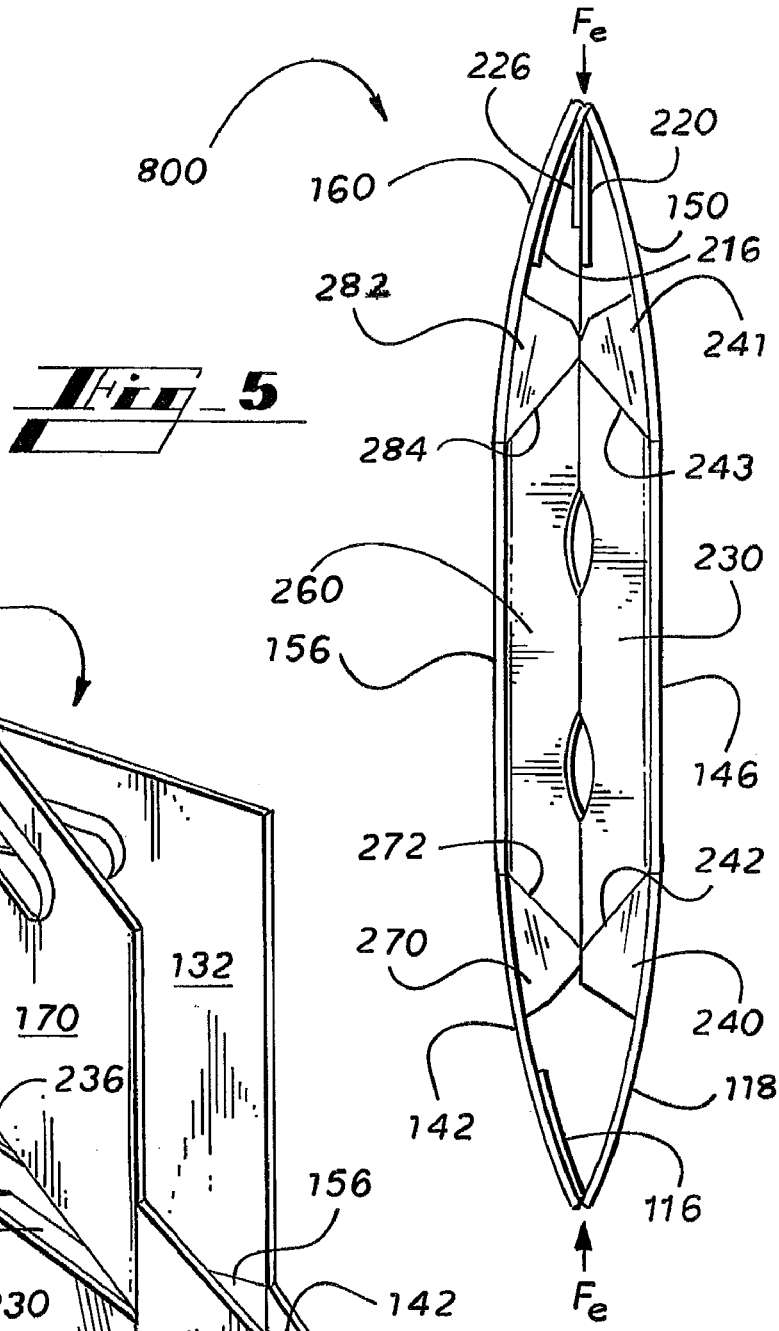
FIGS. 5 and 6 are perspective views of a carrier formed from the blank of FIG. 1, the carrier being in a substantially collapsed condition.
Figure 7:
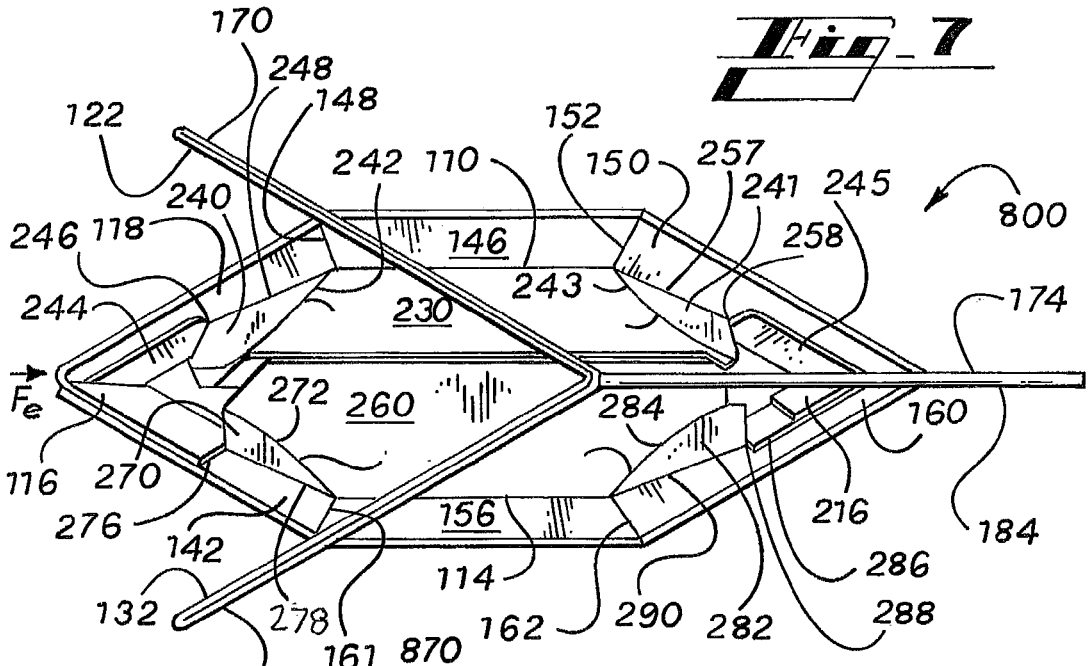
FIG. 7 is a top view of the carrier of FIGS. 5 and 6, the carrier being partially erected.

As best seen in FIGS. 5-7, in which the carrier 800 is in a collapsed condition or a partially erected condition, the bottom panels 230, 260 extend generally vertically within the interior of the carrier 800. In the collapsed condition, the bottom panels 230, 260 extend within the space defined by the collapsed tubular structure such that the bottom panels 230, 260 are substantially parallel to, or coplanar with, the sidewalls 118, 142, 146, 150, 156, 160 and the gusset structures, which include the gusset panels 240, 241, 270, 282 and the gusset attaching tabs 244, 245, 274, 286. The outside surface of the bottom panel 230 is in a face contacting relationship with the outside surface of the bottom panel 260. The inside surfaces of the bottom panels 230, 260 are respectively in a face contacting relationship with the inside surface of respective sidewalls 118, 142, 146, 150, 156, 160 of the tubular structure. Similarly, the outside surfaces of the gusset panels 240, 241 are in a face contacting relationship with the outside surfaces of the gusset panels 270, 282, respectively, which is hereinafter referred to as the first position of the gusset panels 240, 241, 270, 282 The inside surface of each of the gusset panels 240, 241, 270, 282 is in a face contacting relationship with the inside surface of respective sidewalls 118, 150, 142, 160 of the tubular structure.

With the carrier 800 in a collapsed condition as described above, it may then be shipped to a bottler, retailer, or end user who erects the carrier and loads articles, such as filled bottles, into the receiving cells 810, 820, 830. The carrier 800 can be erected from the collapsed condition shown in FIGS. 5-7 to the erected condition shown in FIGS. 8-10 as described below. Referring to FIG. 5, an erecting force, such as opposing forces Fe, may be applied to opposite edges of the collapsed tubular structure of the carrier 800. Applying the forces Fe induces the sidewalls 146, 156 to move outward with respect to one another and induces the sidewalls 118, 142 and the sidewalls 150, 160 to move away from one another about the fold lines 120 and fold lines 218, 221, 228, respectively. As the sidewalls 146, 156 move outward, the gusset panels 240, 241, 270, 282 rotate away from the sidewalls 118, 150, 142, 160 to which the gusset attaching tabs 244, 245, 274, 286 are attached, along respective fold lines 248, 257, 278, 290. Substantially simultaneously, the bottom panels 230, 260 rotate away from one another along the fold line 234 and away from the sidewalls 146, 156 along the fold lines 110, 114, respectively. In fact, it is contemplated that the rotation of the gusset panels 240, 241, 270, 282 causes, encourages, or induces the rotation of the bottom panels 230, 260.

The bottom panels 230, 260 continue to rotate away from one another and the sidewalls 118, 142, 150, 160 continue to rotate away from one another such that the gusset panels 240, 241, 270, 282 incur a certain level of compressive stress causing them to become unstable, thereby inducing the bottom panels, gusset panels, and sidewalls to toggle or spring into an erected position. During the toggle action, the gusset panels 240, 241, 270, 282 rotate relative to the bottom panels 230, 260 about fold lines 242, 243, 272, 284, respectively, and relative to the sidewalls, 118, 150, 142, 160 about fold lines 248, 257, 278, 290, respectively. At the end of the toggle action, the gusset panels 240, 241, 270, 282 are disposed in a second position where the outside surface of each of the gusset panels 240, 241, 270, 282 approaches and generally assumes a face contacting arrangement with the inside surface of a respective sidewall 118, 150, 142, 160 of the tubular structure. Further, the gusset panels 240, 241, 270, 282 are substantially perpendicular to the bottom panels 230, 260, which are substantially coplanar to one another.

Figure 10:
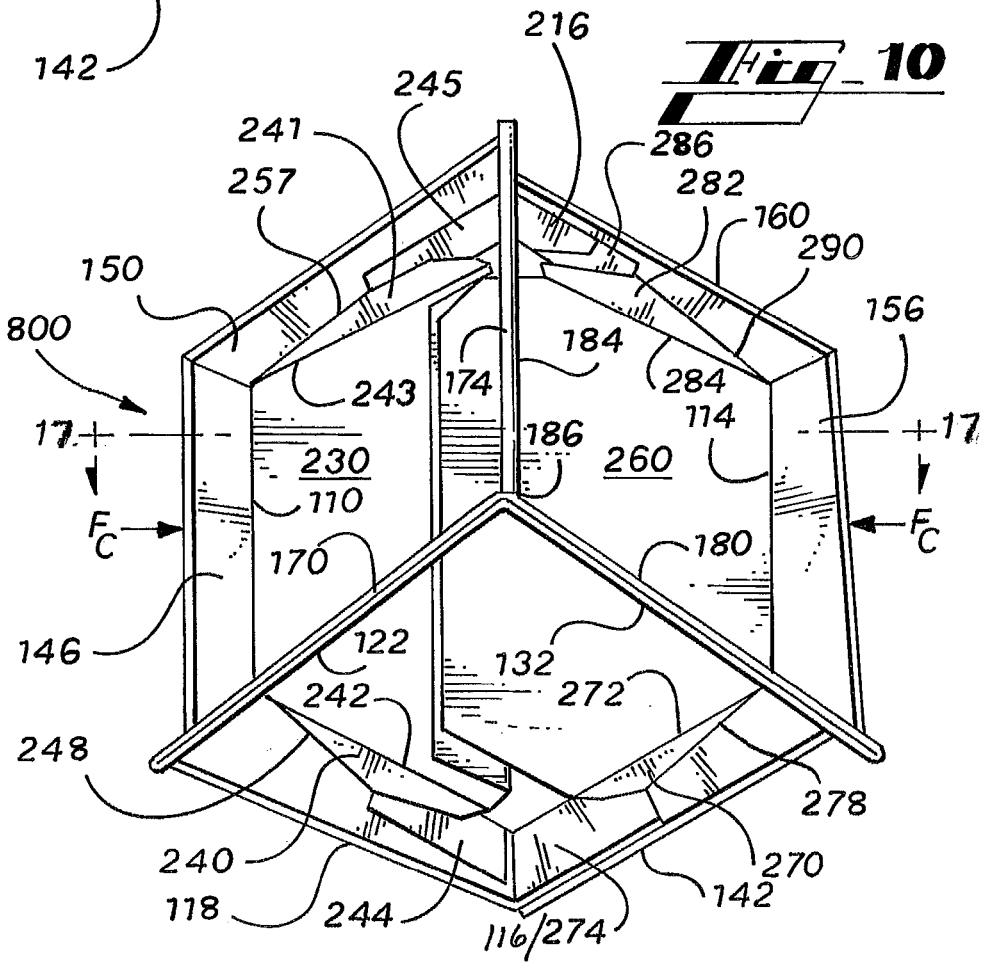
FIG. 10 is a top view of the carrier of FIG. 8.

The carrier may be collapsed by reversing this process, such as by providing opposing forces Fc to opposing sidewalls 146 and 156 of the tubular structure, as shown in FIG. 10. The forces Fc cause the gusset panels to fold toward inward and upward about the fold lines 248, 257, 272, 284 and the bottom panels 230, 260 to fold upward and inward.

Figure 9:
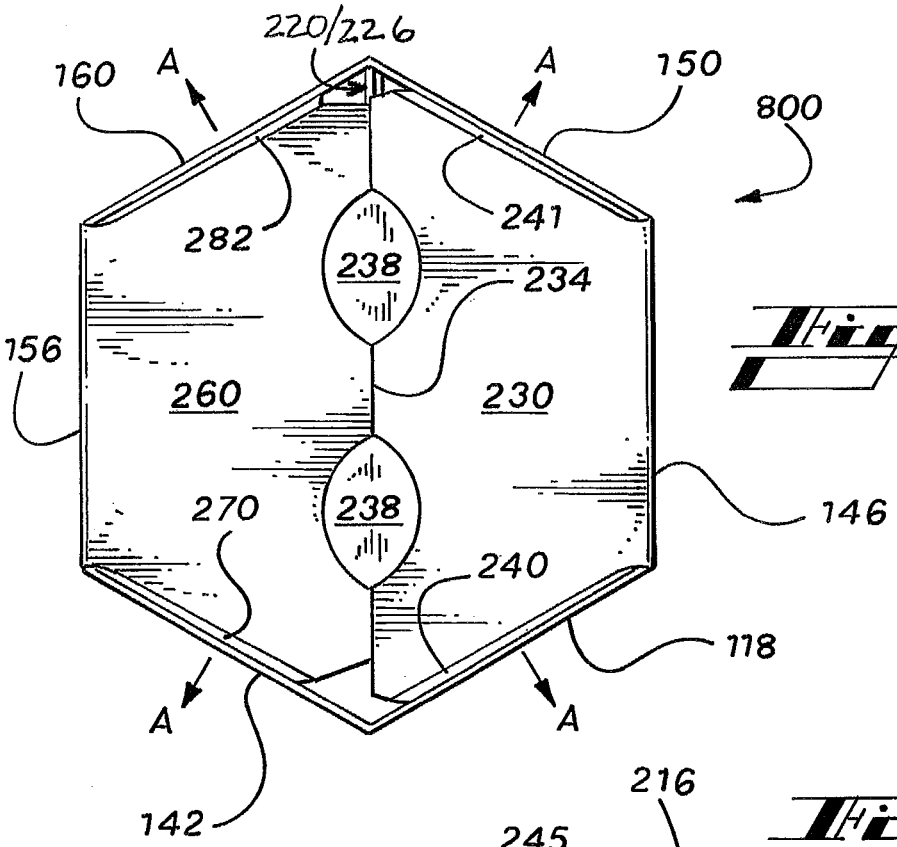
FIG. 9 is a bottom view of the carrier of FIG. 8.
Figure 17:
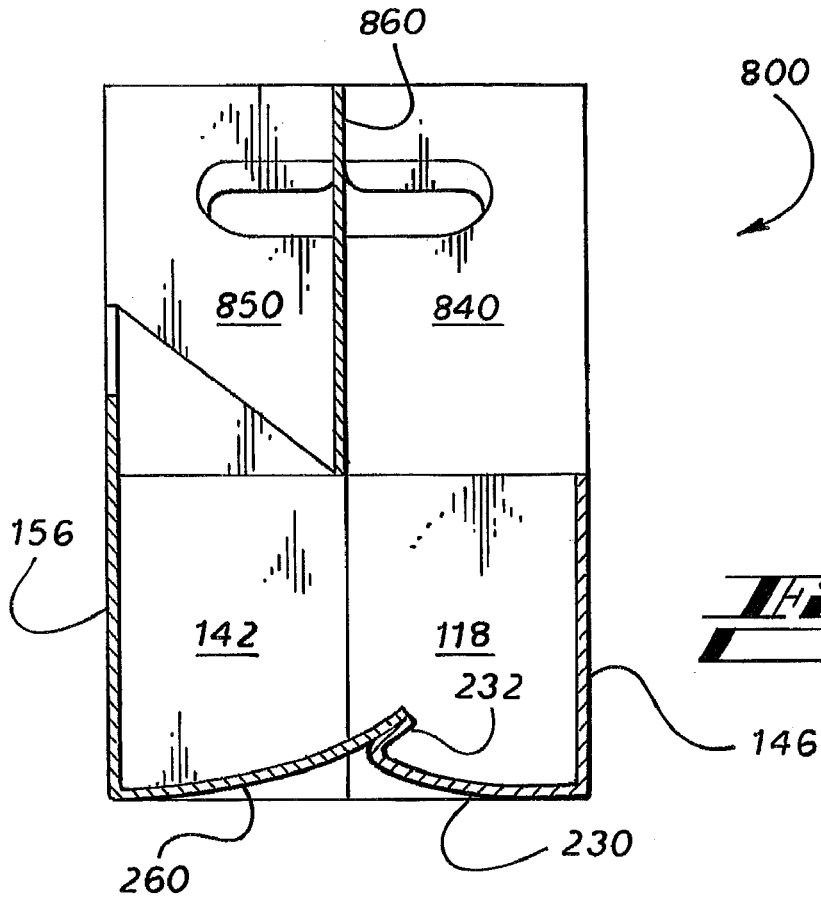
FIG. 17 is a simplified sectional view of the carrier of FIG. 10.

As best shown in FIG. 9, when the carrier 800 is in an erected condition, the bottom panels 230, 260 are substantially coplanar with one another to form a bottom wall that is generally perpendicular to each of the sidewalls of the tubular structure. The bottom panels 230, 260 may bow upward near the hinged connection along fold line 234. Referring to FIG. 17, the overlapping portions of bottom panel 260 and of the end flap 232 of bottom panel 230 extend out of the plane of any flat surface upon which the carrier 800 rests, to provide a buffer for articles disposed on the inside surface of the bottom wall in receiving cells 810, 820, 830. When a bottle is received atop the bottom panels 230, 260, the end flap 232 and bottom panel 260 move downward against the bias of the fold line 234 so that the bottom panels 230, 260 begin to flatten from their upwardly bowed position to a generally horizontal position and the end flap 232 or buffer is at least temporarily compressed against bottom panel 230. During this compressing of the bottom panels 230, 260, gusset panels 240, 241, 270, 282 move outwardly toward their respective sidewalls 118, 150, 142, 160, as represented by the arrows A in FIG. 9, to provide further cushioning at the bottom wall.

A second embodiment of the present invention is shown in FIGS. 11-16. Elements which are substantially similar in the first and second embodiment have been designated by the same reference numerals with the addition of the suffix "A" for elements in the second embodiment. Only primary and pertinent differences between the embodiments are discussed below.

Figure 18:
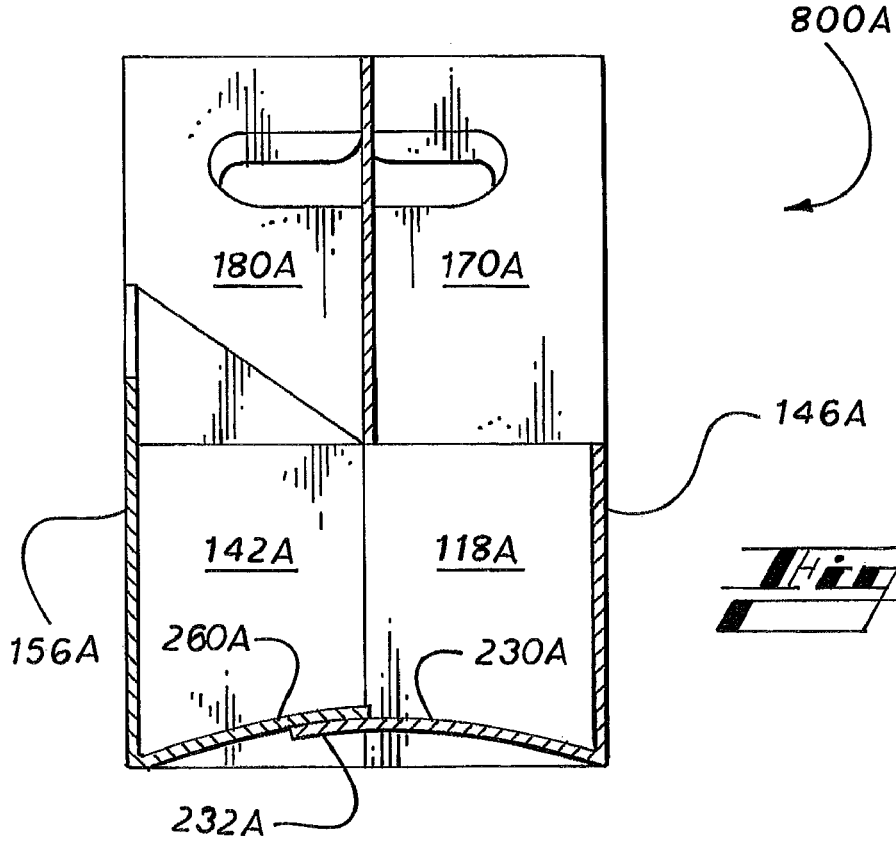
FIG. 18 is a simplified sectional view of carrier of FIG. 15.

In the second embodiment, the gusset structures include second gusset panels 1244, 1245, 1274, 1286 in lieu of the attaching tabs 244, 245, 274, 286. The second gusset panels 1244, 1245, 1274, 1286 are hingedly connected to the sidewall panels 118A, 150A, 142A, 160A along fold lines 250A, 251A, 280A, 292A and to the first gusset panels 240A, 241A, 270A, 282A along fold lines 248A, 257A, 278A, 290A. Bottom panels 230A, 260A are hingedly connected to sidewall panels 146A, 156A along curved fold lines 110A, 114A, respectively. In this embodiment, the fold lines 111A, 114A are curved to facilitate the rotation of bottom panels 230A, 260A to form a bottom wall when the carrier 800A is erected and to encourage the bottom wall to bow inwardly with respect to the tubular structure such that the bottom wall is generally concave, as shown in FIG. 18. Further, a first score line 1220 is provided across bottom panel 230A and end flap 232A, and a second score line 1210 is provided across bottom panel 260A, such that score lines 1210, 1220 are generally aligned upon assembly of the carrier 800A and assist the upward arching of the bottom panels 230A, 260A. In assembly, the top surface of end flap 232A is attached to the bottom surface of bottom panel 260A.

As shown in FIGS. 12 and 13, in the collapsed condition, bottom panels 230A, 260A extend outwardly from the interior of the tubular structure of the carrier and are attached to each other by end flap 232A such that they are hingedly connected along a fold line 234A. When assembled and collapsed, bottom panels 230A, 260A, first gusset panels 240A, 241A, 270A, 282A, and second gusset panels 1244, 1245, 1274, 1286, and the sidewall panels 118A, 146A, 150A, 142A, 156A, 160A are generally in the same plane. The bottom panels 230A, 260A move away from one another but toward the inside surface of the tubular structure when the carrier 800A is erected to an erected condition.

Figure 14:
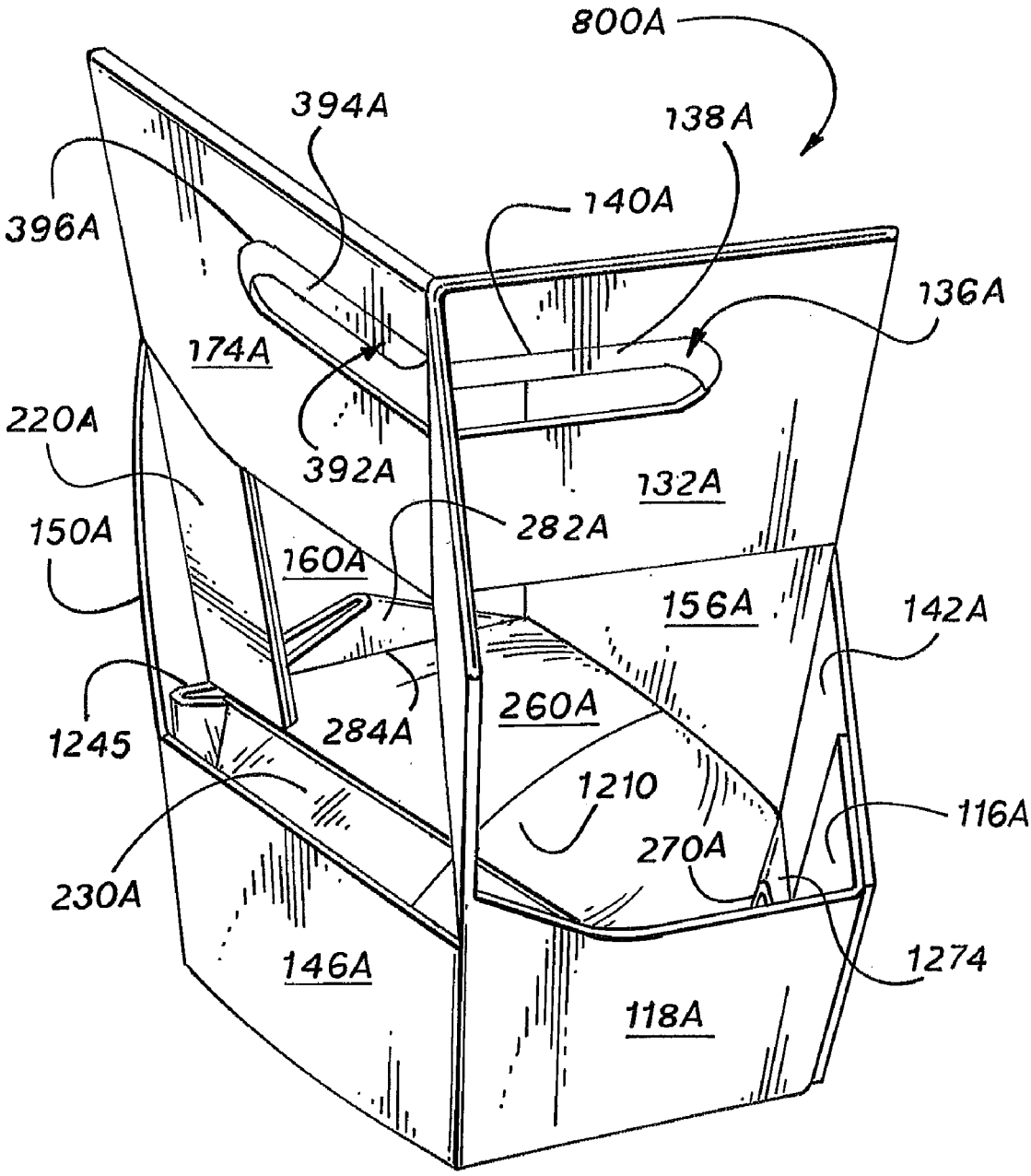
FIG. 14 is a perspective view of the carrier formed from the blank of FIG. 11, the carrier being in an erected condition.

The conversion of the carrier from the collapsed condition shown in FIGS. 12 and 13, to the erected condition shown in FIGS. 14-16, will now be described. An erecting force, such as opposing forces Fe shown in FIG. 13, may be applied to opposite edges of a collapsed carrier 800A. During the initial erecting movement, the sidewalls 146A, 156A begin to move away from one another to define an open end of the tubular structure and the bottom panels 230A, 260A rotate away from one another along fold line 234A and toward the open end of the tubular structure along fold lines 110A, 114A. The second gusset panels 1244, 1245, 1274, 1286 rotate toward the interior of the tubular structure about fold lines 250A, 251A, 280A, 292A, respectively. The first and second gusset panels rotate toward one another about their respective fold lines 248A, 257A, 278A, 290A. The first gusset panels 240A, 241A, 270A, 282A rotate relative to the bottom panels 230A, 260A along fold lines 249A, 243A, 277A, 281A. As the erecting movement continues, gusset panels cause the bottom panels 230A, 260A and sidewalls 118A, 150A, 160A, 142A to toggle or spring into an erected position and maintains the carrier 800A in an erected condition. The curved fold lines 110A, 114A, the score lines 1210, 1220, and fold line 234A assist the bottom panels 230A, 260A in arching upward into the interior of the carrier to maintain the erected condition of the carrier.

Figure 15:
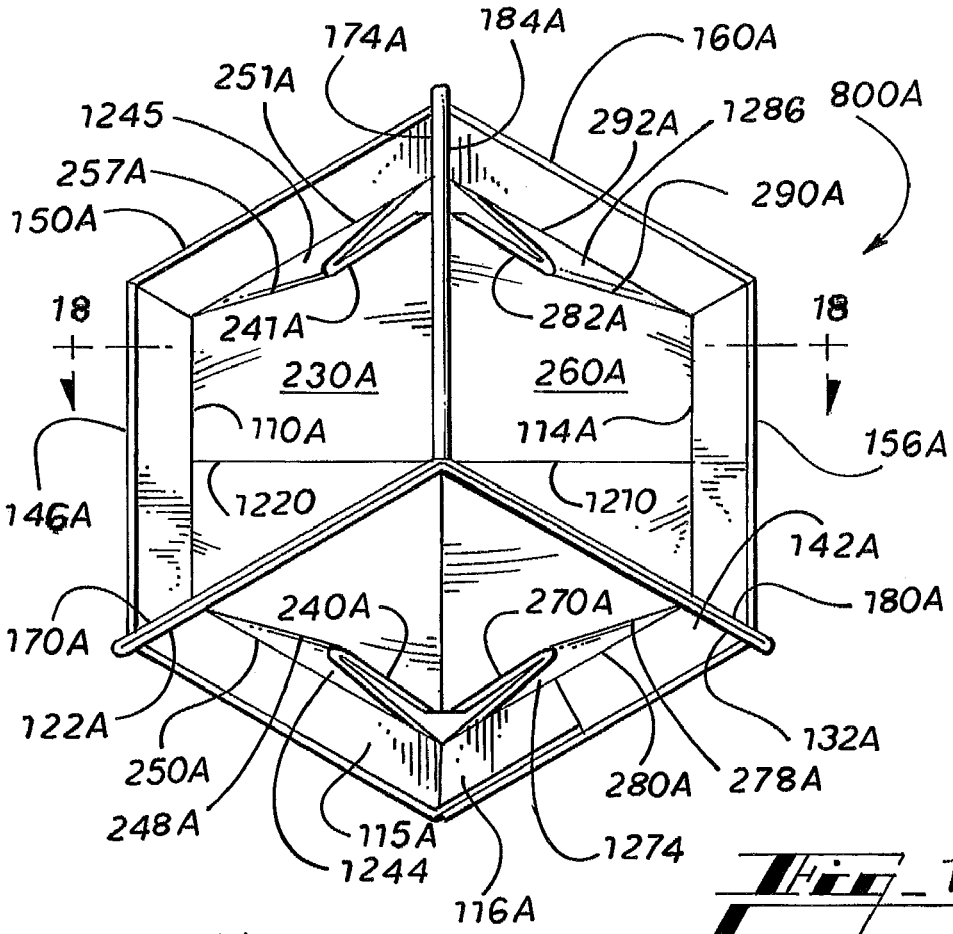
FIG. 15 is a top view of the carrier of FIGS. 12 and 14.
Figure 16:
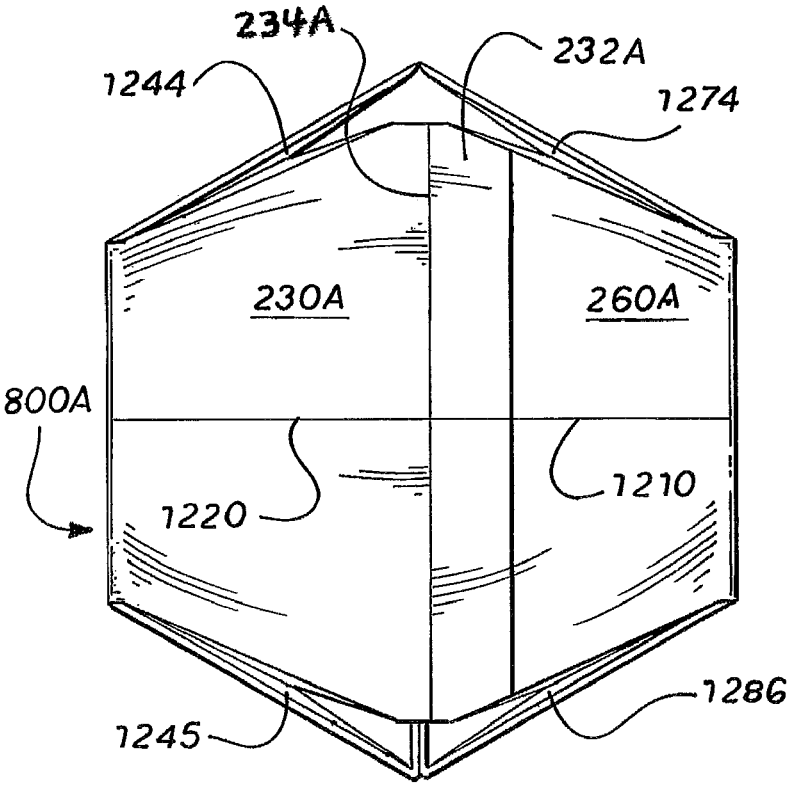
FIG. 16 is a bottom view of the carrier of FIGS. 12 and 14.

With reference now to FIG. 15, in the erected condition, the outside surface of the first gusset panels 240A, 241A, 270A, 282A are in a face contacting relationship with the outside surface of the second gusset panels 1244, 1245, 1274, 1286. The inside surface of second gusset panels 1244, 1245, 1274, 1286 approaches a face contacting relationship with the inside surface of the sidewalls 118A, 150A, 142A, 160A of the tubular structure.

In another embodiment, interior partitions (not shown) may be provided. One purpose for such partitions is to protect an article within a receiving cell from contact with an adjacent article in an adjacent receiving cell. Providing such protection, whether with full height or less than full height walls, reduces the likelihood of damage during loading and transportation.

There are a number of ways to provide interior partitions, whether from a single blank or by adding inserts to a finished carrier made according to the principles taught herein. By way of illustration and not limitation, an embodiment that includes full height interior partition may be constructed from a blank similar to the blank 122A described above.

Figure 11:
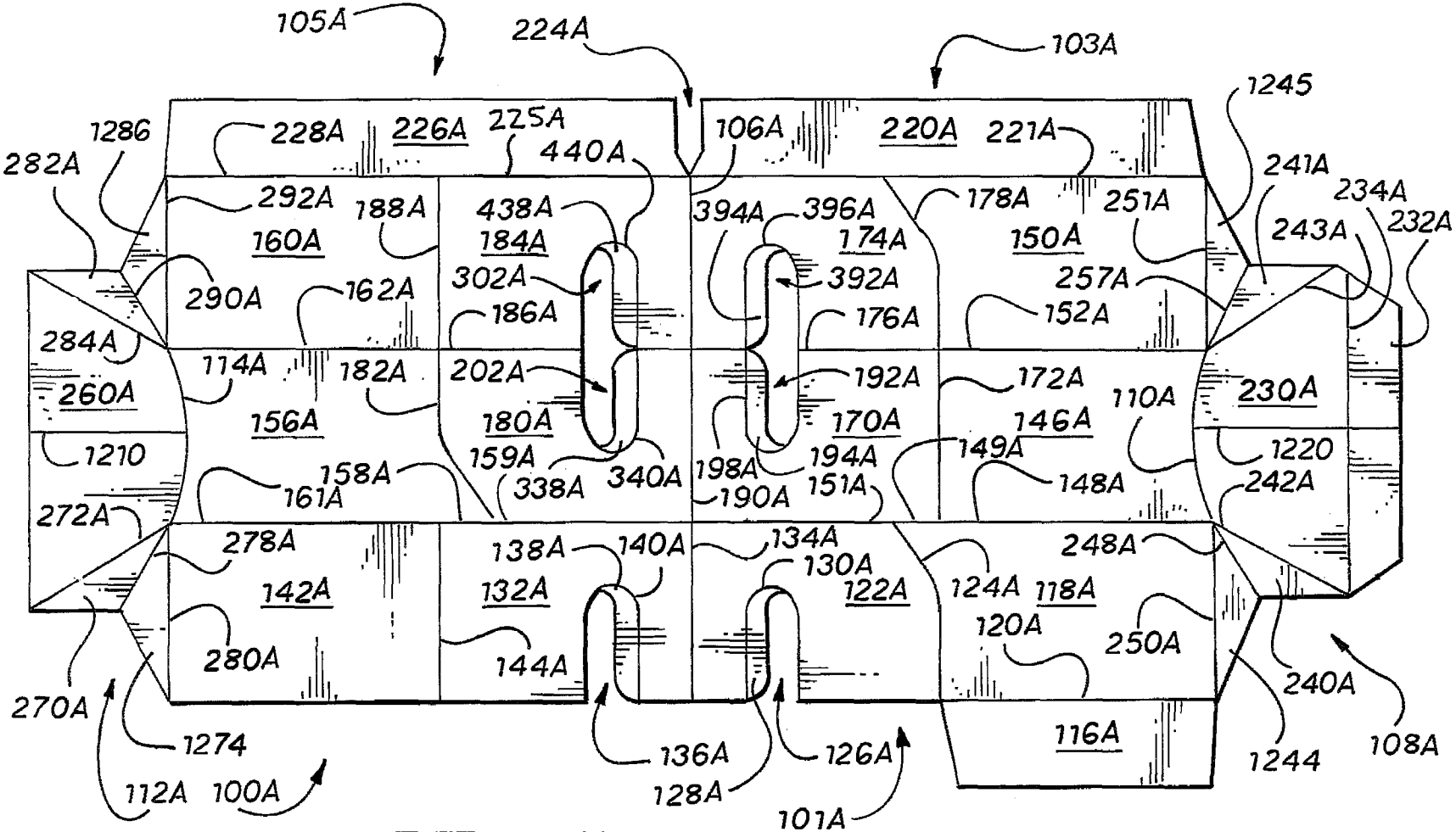
FIG. 11 is a plan view of a blank in accordance with an alternative embodiment of the present invention.

Turning briefly to FIG. 11, interior partitions may be provided by extending the width of any of the panels 116A, 220A, 226A, or 260A. As understood by those skilled in the art, any of these panels may be extended and configured, with the addition of various fold lines, to extend inward or upward into the interior of the carrier. In an efficient embodiment the interior walls will follow the configuration of the handle portions 840, 850, 860, best shown in FIG. 8. For example, the opposite lower halves of panels 220A and 226A may be extended considerably and each provided with a single longitudinal fold line. With the addition of these elements, panels 220A and 226A may jointly extend into the interior of the carrier 800A, similar to the present 200A as shown in FIG. 15. The joint interior panels 220A/226A could be located immediately below divider wall 174A and then diverge, with panel 220A extending partially or fully below one divider wall and panel 226A extending partially or fully below the other divider wall.

It should be appreciated that as used herein, directional references such as "top", "base", "end", "side", "upper" and "lower" do not limit the respective panels to such orientation, but merely serve to distinguish these panels from one another. The orientation of the carrier could be altered depending upon, for example, the articles to be carried in the carrier.

It should be still further appreciated that any reference to a fold line or hinged connection should not be construed as necessarily referring to a single fold line only: indeed it is envisaged that hinged connection can be formed from one or more of the following: a score line, a frangible line, or a fold line, without departing from the scope of the invention. Any reference to a severance line should be construed as a line that has been precut, or that is severable by means of a frangible connection.

The law does not require and it is economically prohibitive to illustrate and describe every embodiment of the present invention. Thus, those skilled in the art will also appreciate that the embodiments described represent only examples of the various carrier types and configurations that will be suitable for implementation of the various embodiments of the invention. Accordingly, the scope of the present invention is described by the claims appended hereto and supported by the foregoing.

What is claimed is:

1. A basket-style carrier, comprising:

a tubular structure comprising a first side wall and a second side wall;

a collapsible bottom wall for at least partially enclosing an end of said tubular structure, said bottom wall comprising a first bottom panel and a second bottom panel, said first bottom panel being hingedly connected to an end edge of said first side wall along a first fold line and said second bottom panel being hingedly connected to an end edge of a second side wall along a second fold line; and at least one gusset structure, comprising:

a gusset attaching tab, said gusset attaching tab being secured in a face contacting arrangement with a surface of said tubular structure; and a gusset panel, said gusset panel being hingedly connected to said gusset attaching tab along a third fold line and being hingedly connected to an edge of one of said first bottom panel and said second bottom panel along a fourth fold line;

wherein said carrier can toggle back and forth between an erected condition and a collapsed condition, said gusset panel being sized and positioned such that said bottom panels and said tubular structure spring into position when moving between a collapsed condition and an erected condition.

2. The carrier of claim 1, wherein in said collapsed condition, said bottom panels, said at least one gusset structure, and said side walls are substantially coplanar.

3. The carrier of claim 1, wherein in said collapsed condition, said first bottom panel, said second bottom panel, and said at least one gusset structure are disposed within said tubular structure.

4. The carrier of claim 1, wherein, the inside surface of said gusset panel is generally in a face contacting relationship with the inside surface of said tubular structure in said collapsed condition and the outside surface of said gusset panel is generally in a face contacting relationship with said the inside surface of said tubular structure in said erected condition.

5. The carrier of claim 1, wherein said fold lines are positioned so as to bias said carrier toward said collapsed condition.

6. The carrier of claim 1, wherein a portion of the outside surface of said first bottom panel and a portion of the outside surface of said second panel are secured together to form said bottom wall, said secured portions extending inwardly with respect to said tubular structure to form a deflectable buffer.

7. The carrier of claim 6, wherein said bottom wall of said carrier is configured to rest on a flat surface, and said secured portions extend at an acute angle with respect to the plane of such a flat surface.

8. A basket-style carrier, comprising:

a tubular structure comprising a first side wall and a second side wall;

a collapsible bottom wall for at least partially enclosing an end of said tubular structure, said bottom wall comprising a first bottom panel and a second bottom panel, said first bottom panel being hingedly connected to an end edge of said first side wall along a first fold line and said second bottom panel being hingedly connected to an end edge of a second side wall along a second fold line; and at least one gusset structure, comprising:

a first gusset panel and a second gusset panel hingedly connected to one another along a third fold line, said first gusset panel being hingedly connected to an edge of one of said first bottom panel and said second bottom panel along a fourth fold line, said second gusset panel being hingedly connected an end edge said tubular strucuter along a fifth fold line, wherein each of said first fold line and said second fold line is generally arcuate so as to cause concave curvature of said bottom wall such that said bottom wall forms a deflectable buffer.

9. The carrier of claim 8, further comprising a score line extending at least partially across said bottom wall to further encourage said curvature.

* * * * *